United States Patent [19]

Gailey

[11] Patent Number: 5,024,034

[45] Date of Patent: Jun. 18, 1991

[54] NON-DIRECTIONAL SUSPENDED CEILING PANELS

[75] Inventor: J. Lynn Gailey, Clover, S.C.

[73] Assignee: Alcan Aluminum Corporation, Cleveland, Ohio

[21] Appl. No.: 444,624

[22] Filed: Dec. 1, 1989

[51] Int. Cl.[5] ..... E06B 3/54

[52] U.S. Cl. ..... 52/484; 52/485; 52/509; 52/489

[58] Field of Search ..... 52/484, 489, 712, 762, 52/763, 768, 485, 486, 476, 509, 144, 714, 773, 775

[56] References Cited

U.S. PATENT DOCUMENTS

| | | | |
|---|---|---|---|
| 1,850,735 | 3/1932 | Venzie | 52/485 |
| 3,720,432 | 3/1973 | Chudler | 52/484 X |
| 3,934,387 | 1/1976 | Moeller | 52/714 X |
| 4,463,537 | 8/1984 | Rodriquez et al. | 52/489 |
| 4,471,593 | 9/1984 | Ragland | 52/509 X |
| 4,520,607 | 6/1985 | Suchow | 52/489 |
| 4,696,141 | 9/1987 | Nassof | 52/484 |
| 4,736,564 | 4/1988 | Gailey | 52/484 |
| 4,760,677 | 8/1988 | Nassof | 52/484 |

*Primary Examiner*—David A. Scherbel
*Assistant Examiner*—Creighton Smith
*Attorney, Agent, or Firm*—Calfee, Halter & Griswold

[57] ABSTRACT

A new and useful latch structure for suspending ceiling panels from a grid of inverted T-beam support members. The latch structure comprises a relatively rigid, hook-shaped member which is coupled to a respective ceiling panel so as to move with the ceiling panel relative to the inverted T-beam support members. Each hook-shaped member can tilt, or pivot, relative to its respective ceiling panel. Each hook-shaped latch member is biased by gravity toward a locking position. As a ceiling panel is brought upward against an inverted T-beam support member, the inverted T-beam support member engages the hook-shaped latch member and tilts the latch member away from its locking position, to allow the latch member to clear the inverted T-beam support member. Once the hook-shaped latch member clears the transverse leg of the inverted T-beam support member, the latch member tilts, or pivots, under the influence of gravity, to its locking position. In that position, a locking portion of the latch member will engage the top side of the transverse leg of the T-beam support member, and suspend the ceiling panel from the T-beam support member. An access opening in the ceiling panel enables the hook-shaped latch member to be disengaged from the inverted T-beam member. The access opening is designed to allow any handy implement (e.g., pencil, screwdriver, etc.) to be inserted therethrough to tilt the latch member away from its locking position, to enable the latch structure to be disengaged from the T-beam support member. The ceiling panel can then be readily removed from the inverted T-beam support member.

13 Claims, 6 Drawing Sheets

NON-DIRECTIONAL SUSPENDED CEILING PANELS

TECHNICAL FIELD

This application relates to a system for suspending ceiling panels from a grid formed of inverted T-beam support members, and particularly to a special latch structure for suspending the ceiling panels from the inverted T-beam support members. The latch structure enables the ceiling panels to be simply and efficiently connected and disconnected from the inverted T-beam support members in a manner which is "non-directional", i.e., in a way which does not require attachment or detachment of any adjacent panels of the suspended ceiling.

BACKGROUND

In suspended ceiling structures, it is well known to suspend ceiling panels from a grid made of inverted T-beam support members. The inverted T-beam support members extend downward from a permanent ceiling structure, and enable the ceiling panels to be suspended therefrom in spaced relation to the permanent ceiling. The suspended ceiling panels are typically supported from the grid of inverted T-beam members in edge-to-edge relation, to form a decorative ceiling which conceals the supporting grid and the permanent ceiling from view. Moreover, the suspended ceiling is spaced from the permanent ceiling, to allow utility items such as pipes, ductwork, electrical wiring, etc. to be conveniently located in the hidden space between the decorative, suspended ceiling and the permanent ceiling.

There are several known ways to attach or suspend ceiling panels from inverted T-beam support members. Many of the known ways utilize spring clips or wires to attach and detach the ceiling panels from the inverted T-beam support members (see e.g. U.S. Pat. Nos. 4,463,537; 4,520,607).

Another known way of supporting ceiling panels from inverted T-beam support members is by means of torsion spring mounts. A series of U-shaped hardened wires are attached to the ceiling panels. The U-shaped wires are inserted into pre-punched slots along the horizontal edge of the inverted T-beam support members. The wires spring outward holding the ceiling panels against the horizontal face of the inverted T-beam support members. Such spring systems require special punching of the T-beam support members to receive the wires of each ceiling panel.

An example of a ceiling system which does not use wires or springs for suspending ceiling panels from a grid of inverted T-beam support members is disclosed in U.S. Pat. No. 4,760,677. The ceiling system comprises ceiling panels with specially formed flanges, slots and detents for enabling the ceiling panels to be attached and detached from the grid of inverted T-beam members.

Another ceiling system which does not use spring devices for attaching ceiling panels to inverted T-beam support members is shown in U.S. Pat. No. 4,736,564. The system includes ceiling panels which are attached to inverted T-beam supports by an up-and-side motion of the ceiling panels relative to the inverted T-beam support members to retain the ceiling panels on the inverted T-beam support members. However, such a system is "directional" in the sense that each panel has to be attached to the grid of inverted T-beam support members in a certain way relative to adjacent panels. Moreover, a ceiling panel near the center of the suspended ceiling cannot be removed from the grid of inverted T-beam support members without removing one or more adjacent ceiling panels. Thus, the ceiling panels have to be attached or detached from the grid of inverted T-beam members in a special order, especially when it is desired to attach or remove a central ceiling panel.

SUMMARY OF THE PRESENT INVENTION

The present invention provides a special latch structure for suspending ceiling panels from a grid of inverted T-beam support members. The latch structure is designed such that any panel can be attached to or separated from the grid of inverted T-beam support members in a simple, efficient manner, and without having to attach or separate adjacent ceiling panels from the grid of inverted T-beam support members.

The latch structure preferably comprises one or more relatively rigid, hook-shaped latch members coupled to each ceiling panel. The hook-shaped latch members coupled to each respective ceiling panel are movable with the ceiling panel. Moreover, each hook-shaped latch member can tilt, or pivot, relative to its respective ceiling panel.

Each hook-shaped latch member is biased by gravity relative to its respective ceiling panel toward a locking position. In the locking position, a locking portion of the hook-shaped latch member extends away from the ceiling panel. As a ceiling panel is brought upward against an inverted T-beam support member, the inverted T-beam support member engages the locking portion of the latch member. The inverted T-beam support member exerts a force on the locking portion of the latch member, causing the hook-shaped latch member to tilt, or pivot, away from its locking position, to allow the locking portion of the latch member to clear the transverse leg of the inverted T-beam support member. Once the locking portion of the latch member clears the transverse leg of the inverted T-beam support member, the latch member pivots under the influence of gravity and return to its locking position. When the latch member has returned to its locking position, the locking portion of the latch member will engage the top side of the transverse leg of the inverted T-beam support member, and suspend the ceiling panel from the inverted T-beam support member.

An access opening is provided in each of the ceiling panels. The access opening is located so that when the latch member associated with the ceiling panel is suspending the ceiling panel from the inverted T-beam support member, the access opening is disposed just below the T-beam support member. In order to remove a ceiling panel from the grid of T-beam support members, it is simply necessary to manually push upward on an adjacent ceiling panel, to uncover the access opening of the ceiling panel which is to be removed. Any handy implement (e.g., pencil, screwdriver, etc.) can be inserted through the access opening and forced against the latch member, to tilt, or pivot, the latch member away from its locking position, so that the locking portion can clear the inverted T-beam support member. The ceiling panel can then be readily removed from the inverted T-beam support member.

The latch structure comprises a relatively rigid hook-shaped member having a base portion and the locking portion integral therewith. The hook-shaped member is attached to the ceiling panel by inserting the base portion through an insertion opening in a side wall of the ceiling panel. The hook-shaped latch member can tilt, or pivot, about an edge of the access opening. The base portion is heavier than the locking portion of the latch member, and biases the hook-shaped latch member, under the influence of gravity, to its locking position. In the locking position, the hook-shaped locking portion extends away from the side wall of the ceiling panel, preferably at an acute angle thereto. The base portion has an integral retaining tab which prevents the base portion from being separated from the ceiling panel, unless the hook-shaped member is moved to a certain orientation relative to the ceiling panel and the retaining tab is depressed. The retaining tab minimizes the risk of accidental separation of the hook-shaped member from the ceiling panel.

The further objects and features of the present invention will become further apparent from the following detailed description and the accompanying drawings.

DETAILED DESCRIPTION OF THE PREFERRED EMBODIMENT

As discussed above, the present invention relates to ceiling panels with special latch structure enabling the ceiling panels to be suspended or separated from a grid of inverted T-beam support members, without the need to suspend or separate adjacent panels from the grid of inverted T-beam support members.

Figure 1:
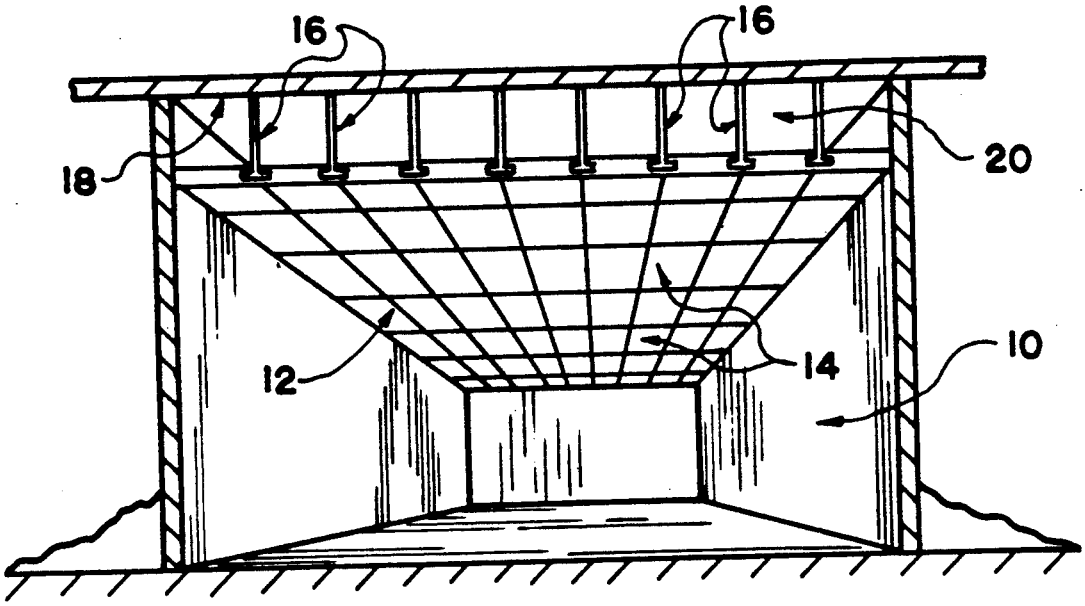
FIG. 1 is a schematic, perspective illustration of a room with a suspended ceiling.

FIG. 1 schematically illustrates a room 10 with a suspended ceiling 12. The suspended ceiling 12 comprises a series of ceiling panels 14 suspended from a grid of inverted T-beam support members 16. The inverted T-beam support members are attached to a permanent ceiling 18 (e.g., either directly or by attachment means such as cables).

The ceiling panels 14 can be made of any known ceiling panel material (e.g., aluminum). The ceiling panels 14 are connected to the grid of inverted T-beam support members 16 by the special latch structure described below. As seen in FIG. 1, when connected to the grid of inverted T-beam support members 16, the ceiling panels 14 form a substantially continuous expanse across the room 10. Specifically, the ceiling panels 14 are connected to the grid of inverted T-beam support members 16 so that the ceiling panels 14 are disposed in edge-to-edge relationship, with their decorative portions located below the inverted T-beam grid, and hiding the T-beam grid and the permanent ceiling 18 from view from below the ceiling 12. Also, the ceiling panels 14 are spaced from the permanent ceiling 18, and the hidden space 20 between the ceiling panels 14 and the permanent ceiling 18 forms a convenient location for utilities, such as pipes, duct work, electrical wires, etc.

Figure 2:
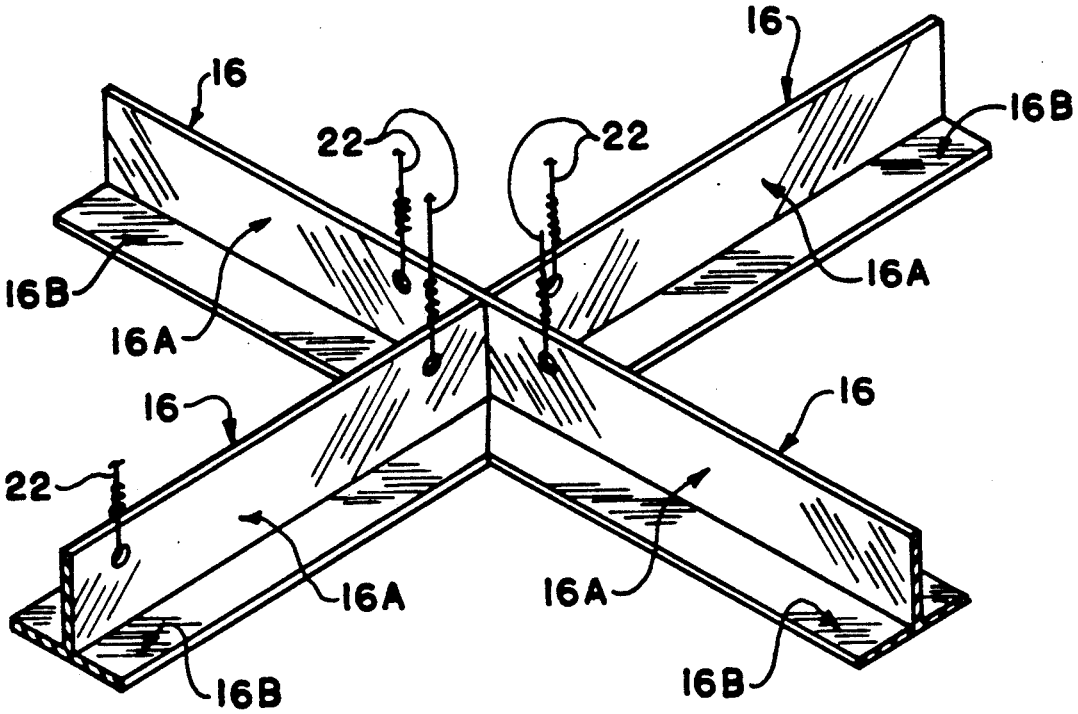
FIG. 2 is a fragmentary, perspective view of a grid of inverted T-beam support members.

The inverted T-beam support members 16 form a regular grid pattern (see FIG. 2). Typically, the grid pattern is configured to correspond to the configuration of the ceiling panels to be suspended therefrom. Thus, when the ceiling panels have rectangular main body portions the inverted T-beam support members 16 would be formed into a regular, rectangular grid. Each inverted T-beam support member 16 has a central portion 16A which extends vertically downward from the permanent ceiling, and a transverse leg 16B at the lower end of the central portion 16A. The central portions 16A of the inverted T-beam support members 16 can be attached directly to the permanent ceiling, or they can be attached to the permanent ceiling by means of cables (shown at 22 in FIG. 2). The means for connecting the inverted T-beam support members 16 to a permanent ceiling are well known to those in the art, and should require no further description.

Figure 3:
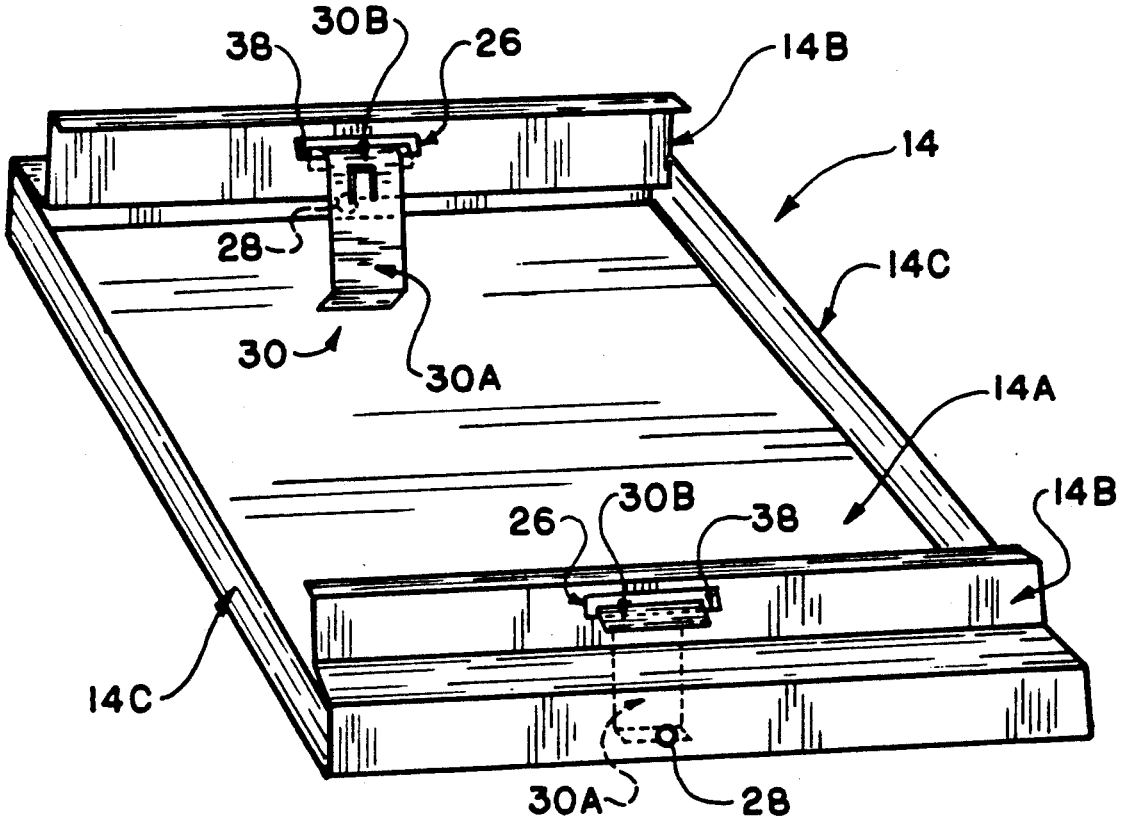
FIG. 3 is a schematic, three dimensional view of a ceiling panel with a latch structure constructed according to the principles of this invention coupled thereto.

Referring to FIG. 3, each ceiling panel 14 has a main, decorative body portion 14A, and a pair of relatively thin side walls 14B extending away from the opposite sides of the main body portion 14A. Each side wall 14B has a stepped configuration. Further, each ceiling panel 14 includes a pair of end walls 14C extending away from opposite ends of the main body portion 14A. The main body portion 14A defines the decorative portion of the ceiling panel 14. The stepped side walls 14B are adapted to support the special latch structure of the invention, as described hereinafter.

Each ceiling panel 14 is formed of a conventional ceiling panel material. For example, each ceiling panel 14 can be integrally formed of aluminum, with the side walls 14B and the end walls 14C formed integrally with the main body portion 14A.

Each side wall 14B has at least a pair of openings 26, 28 extending therethrough. A rectangular insertion opening 26 is designed for receiving the special latch structure of the invention. An access opening 28, spaced from the insertion opening 26, is designed to enable the latch structure to be manipulated in a manner which enables the ceiling panel associated with the latch structure to be separated from a T-beam support member 16, as discussed below.

Figure 5:
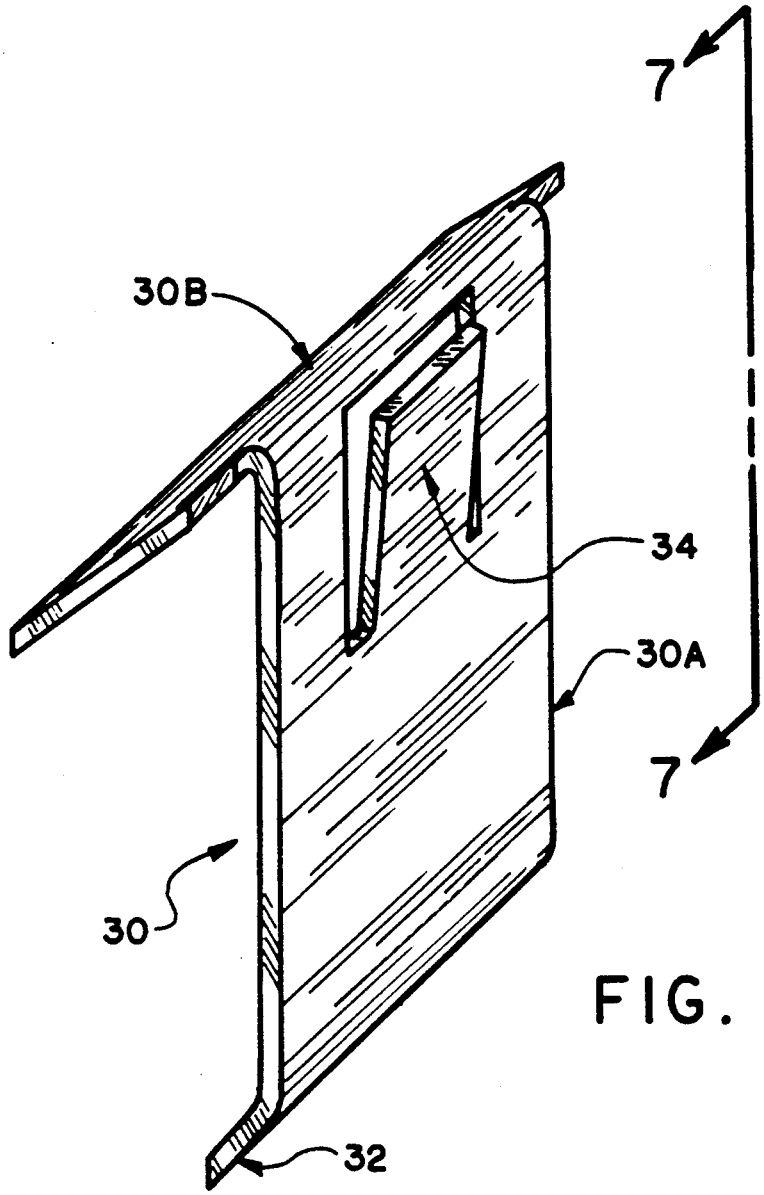
FIG. 5 is a schematic, enlarged, three dimensional view of a latch structure according to the invention.
Figure 7B:
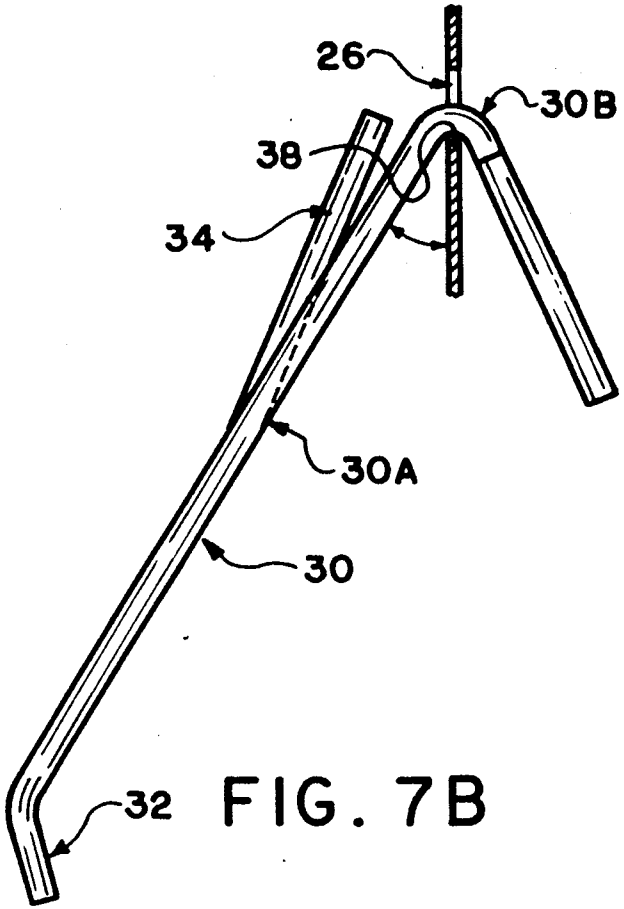
FIG. 7B is a view of the latch member of FIG. 7, and schematically illustrating the manner in which the latch member can tilt or pivot relative to the opening in the ceiling panel.
Figure 7A:
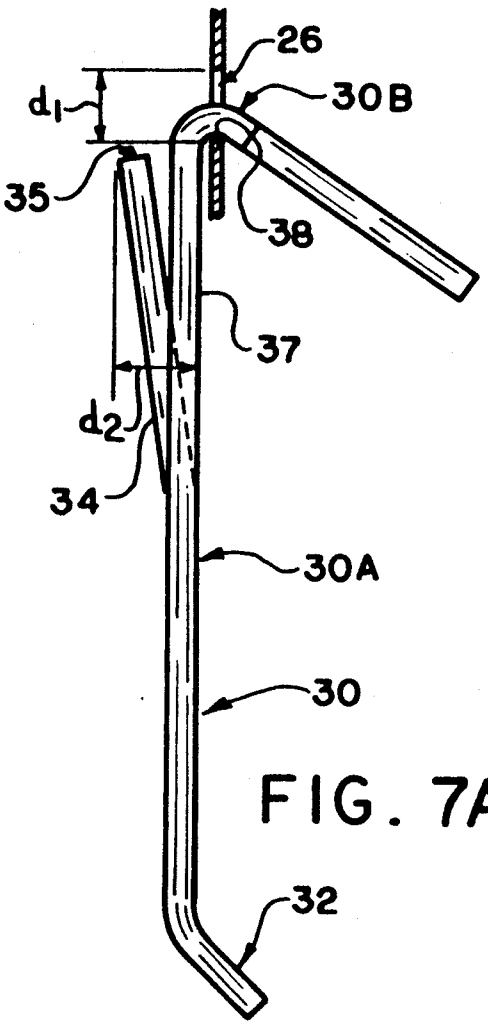
FIG. 7A is a view of the latch member of FIG. 7 hooked about an insertion opening in a ceiling panel.
Figure 7:
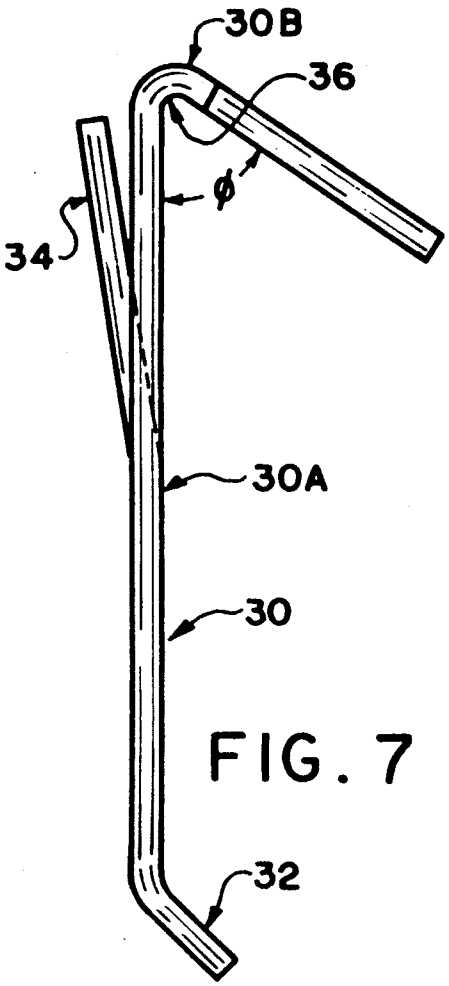
FIG. 7 is a enlarged, side elevational view of the latch member of FIG. 5, taken from the direction 7—7.

The latch structure according to the invention is illustrated in FIGS. 5 and 7. The latch structure comprises a hook-shaped member including a base portion 30A and a hook-shaped locking portion 30B. The base portion 30A is relatively flat, with a bent bottom edge 32. The hook-shaped member 30 is bent relative to the base portion 30B, so that the locking portion 30B extends at an acute angle $\phi$ relative to the base portion 30A (see FIG. 7). The base portion 30A is narrower than the hook-shaped locking portion 30B (see FIG. 5). The base portion 30A is longer than the hook-shaped locking portion 30B and is heavier than the hook-shaped locking portion 30B, for reasons explained below. Further, the base portion 30A has a bent tab portion 34 which forms a restriction against accidental release of the hook-shaped latch member 30 from a ceiling panel, as described more fully below.

Figure 6:
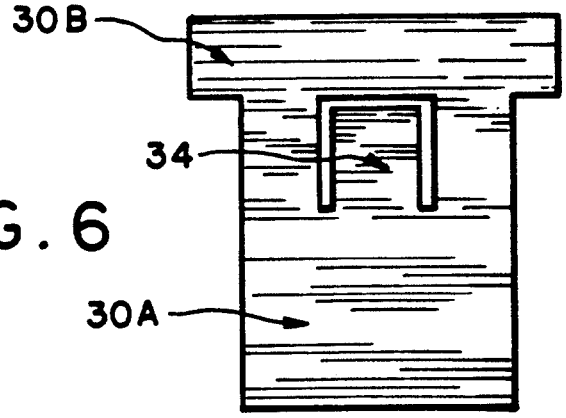
FIG. 6 is a top plan view of a blank used to form the latch structure of the invention.

Preferably, each hook-shaped latch member 30 is a unitary member. The latch structure 30 is preferably formed of aluminum, or other metal. The latch structure is formed by initially forming a relatively flat blank in the shape shown in FIG. 6, and then deforming the blank into the configuration shown in FIGS. 5 and 7. When the latch member 30 is bent into the hook-shaped configuration of FIGS. 5, 7, the latch member 30 has a curved wall 36 which allows the latch member 30 to hook about an edge 38 of the insertion opening 26 in the side wall 14B (FIG. 7A), or to rock or pivot about the edge 38 of the insertion opening (FIG. 7B), as described more fully below. Specifically, the latch member 30 is "relatively rigid" in the sense that it can tilt, or pivot, as a rigid body relative to the ceiling panel 14, as described below.

Each latch member 30 is coupled with a respective ceiling panel 14 by inserting the base portion 30A of the latch member through the insertion opening 26 in the side wall 14B of the ceiling panel 14. The latch member 30 is hooked downwardly around the bottom edge 38 of insertion opening 26, with the base portion 30A of the latch structure on the "inside" of the ceiling panel 14 and the locking portion 30B of the latch member disposed "outside" the ceiling panel 14. In this application, reference to the base portion 30A of the latch member being on the "inside" of the ceiling panel 14 means that the base portion 30B of the latch member 30 is disposed between the side walls 14B of the ceiling panel 14. Reference to the locking portion 30B of the latch member 30 being disposed "outside" of the ceiling panel 14 means that the locking portion 30B is disposed outside the side walls 14B. When a latch member 30 is hooked downwardly around the edge 38 of an insertion opening 26, the heavier base portion 30A hangs straight downwardly under the influence of gravity (see FIGS. 3, 4). The locking portion 30B extends outward from side wall 14B, at an acute angle thereto (see FIG. 4). That position of the latch member 30 is referred to herein as the "locking position", for reasons that will become clear hereinafter.

When a latch member is hooked downwardly about the edge 38 of an insertion opening, in the manner described above, the latch member 30 is coupled to the ceiling panel 14. The latch member 30 will move upwardly or downwardly with the ceiling panel 14, as the ceiling panel is being suspended from or separated from an inverted T-beam support member 16.

The bent tab portion 34 of each latch member 30 insures that the latch member 30 cannot be accidentally dislodged from the ceiling panel 14. The bent tab portion 34 is located so that the base portion 30A of the latch member would have to be oriented substantially horizontal in order for the latch member to be removed through the insertion opening 26. Bringing the base portion 30A of the latch member 30 to a horizontal orientation requires moving the latch member 30 against its bias due to gravity. Moreover, the distance $d_2$ from the distal end 35 of tab 34 to the opposite side 37 of the base portion 30B is greater than the width $d_1$ of the insertion opening 26 (see FIG. 7A). Accordingly, the bent tab portion 34 of the latch member minimizes the risk of accidental dislodgement of a latch member from its associated ceiling panel 14.

Figure 8:
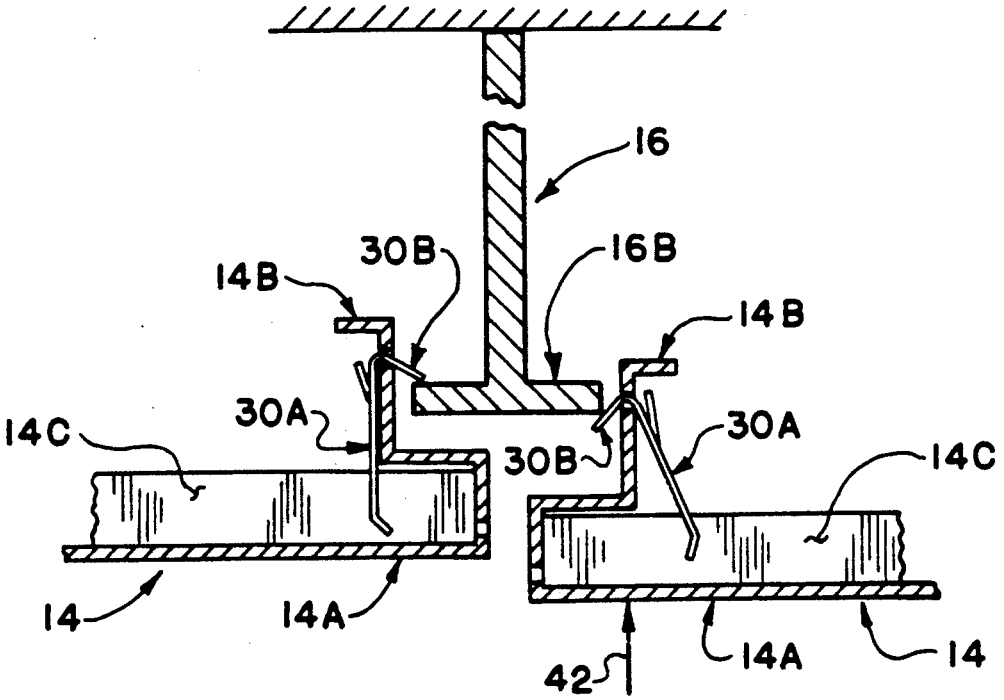
FIGS. 8 and 9 are fragmentary, schematic, cross-sectional illustrations of elements of a suspended ceiling system, showing certain relative positions of an inverted T-beam support member, a pair of ceiling panels, and a pair of respective latch members, as a ceiling panel is being attached to the inverted T-beam support member.
Figure 9:
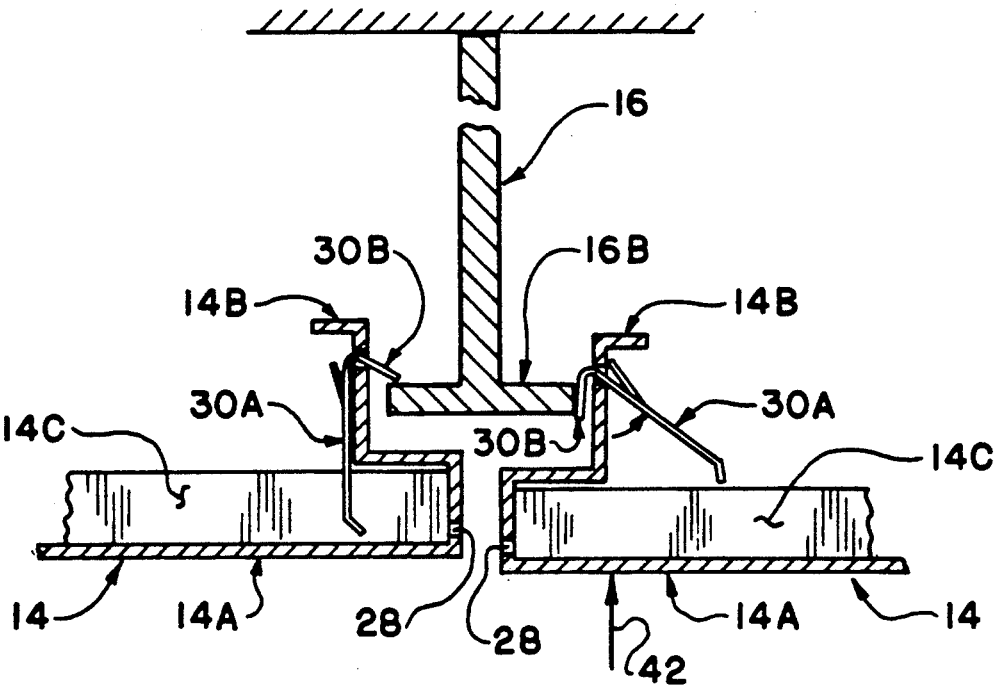

FIGS. 8 and 9 illustrate the manner in which a ceiling panel is suspended from an inverted T-beam support member 16. The ceiling panel 14 located beneath the inverted T-beam support member 16, and is pushed upwardly relative to the inverted T-beam support member. In FIGS. 8 and 9, the arrow 42 illustrates that the right ceiling panel 14 is being pushed upwardly to suspend the ceiling panel from the inverted T-beam support member 16. As the ceiling panel 14 is pushed upwardly, the locking portion 30B of the latch member engages the bottom 16B of the transverse leg of the inverted T-beam support member 16B. The transverse leg 16B applies a moment to the relatively rigid latch member 30, causing the latch member 30 to pivot or tilt (in the direction shown) to bring the locking portion 30B of the latch member adjacent the side wall 16B (see FIG. 9). When the latch member 30 is in that orientation it can clear the transverse leg 16B of the inverted T-beam support member 16, as the latch member 30 moves upward with the ceiling panel 14. When the locking portion 30B of the latch member clears the transverse leg 16B of the inverted T-beam support member, the heavier base portion 30A causes the latch to tilt about the edge 38 of the insertion opening 26, to bring the latch member 30 back into its locking position. When the latch member 30 returns to its locking position, the locking portion 30B of the latch member extends away from the side wall 14B, and is located to engage the top side of the transverse leg 16B of the inverted T-beam support member 16. In that position, the latch member 30 suspends the ceiling panel 14 from the inverted T-beam support member (see FIG. 4).

Of course, while a single latch member 30 has been described, it should be clear to those of ordinary skill in the art that such latch members can be coupled with both side walls 14B of a single ceiling panel (see FIG. 3). Moreover, more than one latch member can be attached to each side wall of a ceiling panel. The latch members 30 are designed to suspend the ceiling panel 14 from a plurality of inverted T-beam support members 16 by pushing the ceiling panel upward relative to the inverted T-beam support members 16. Further, it should be clear that each ceiling panel 14 can be attached to the grid of inverted T-beam support members without regard to, or without needing to disturb, any adjacent ceiling panels.

Figure 4:
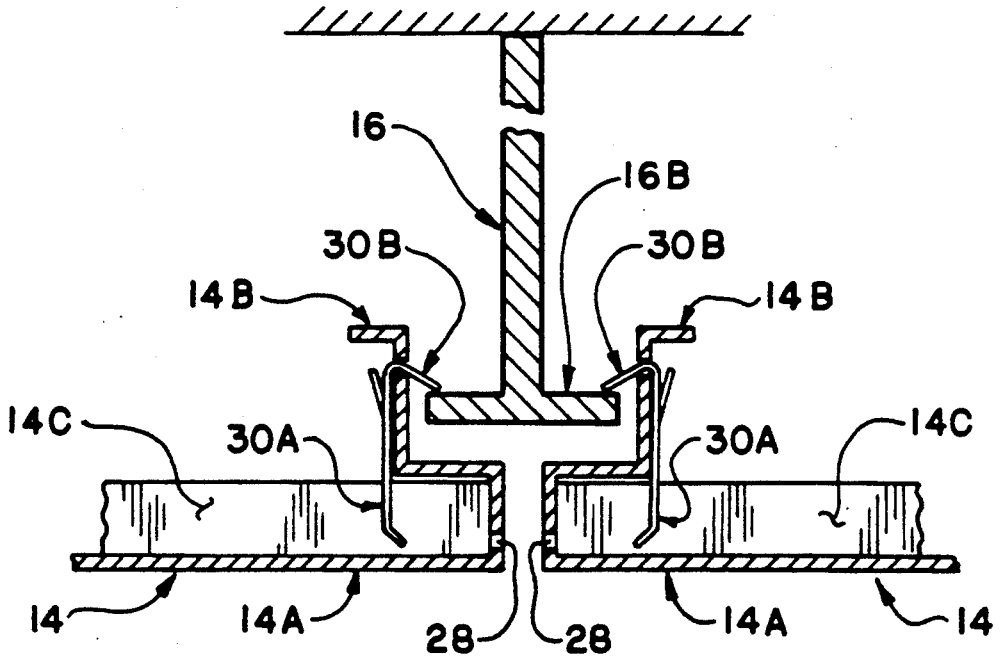
FIG. 4 is a fragmentary, schematic, cross-sectional view of an inverted T-beam member with a pair of ceiling panels suspended therefrom by means of the latch structure of the invention.

When a series of the ceiling panels 14 are attached to the grid of inverted T-beam support members 16, the main body portions 14A of the ceiling panels 14 will typically extend in edge-to-edge relationship, and form a generally continuous expanse across the room or area they cover (see FIGS. 1 and 4). The decorative main bodies 14A of the ceiling panels are the only visible parts of ceiling, and hide the inverted T-beam support members 16 and the space 20 between the ceiling panels and the permanent ceiling, when viewed from beneath the ceiling (see FIG. 1).

Referring to FIG. 4, when an array of the ceiling panels 14 are attached to the grid of inverted T-beam support members, the access openings 28 in the side walls 14B of the ceiling panels are located below the transverse legs 16B of the inverted T-beam support members. The side walls 14B, and hence the access openings 28, would be generally hidden from view from below the ceiling panels 14.

Figure 10:
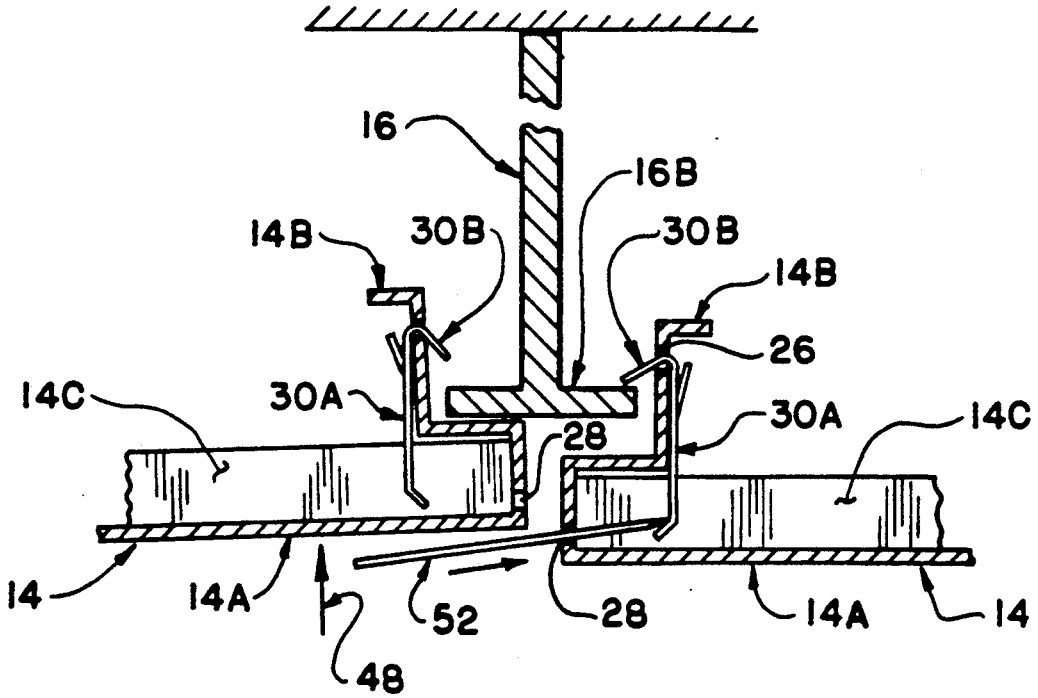
FIG. 10 is a fragmentary, schematic, cross-sectional illustration of elements of a suspended ceiling system, showing certain relative positions of an inverted T-beam support member, a pair of ceiling panels and their respective latch members, as a ceiling panel is being separated from the T-beam support member.

In order to remove one ceiling panel 14 from the ceiling 12, an adjacent panel is pushed slightly upward to uncover the access opening 28 in the ceiling panel to be removed (see the upward movement of the adjacent panel depicted by arrow 48 in FIG. 10). Any convenient implement 52, i.e., a pencil, pen, screwdriver, can be then inserted through the access opening 28. Because the latch member 30 hangs with its base portion 30A near the access opening 28, when an implement 52 is inserted through the access opening 28, the implement can easily push against the base portion 30A, and cause the latch member 30 to tilt upward, against its gravitational bias, to bring the locking portion 30B of the latch member away from its locking position and adjacent the side wall 14B of the panel (i.e., into the orientation shown in FIG. 9). In that orientation, the latch member 30 can clear the transverse leg 16B of the inverted T-beam support member, to enable the ceiling panel 14 associated with the latch member to be simply removed from the inverted T-beam support member. This provides a convenient and simple way of separating a ceiling panel from the grid of inverted T-beam support members, without having to remove other ceiling panels from the ceiling.

Accordingly, the present invention provides a simple and efficient latch structure for suspending and releasing decorative ceiling panels from a grid of inverted T-beam support members. With the principles of the present invention in mind, it is believed that various obvious modifications of the invention will become apparent to those of ordinary skill in the art.

I claim:

1. Apparatus comprising an inverted T-beam support member, a ceiling panel, and a latch structure for suspending the ceiling panel from the inverted T-beam support member;

said latch structure being coupled with said ceiling panel and being movable therewith relative to said inverted T-beam support member;

said latch structure being moveable relative to said ceiling panel and being biased by gravity toward a locking position;

said latch structure being adapted to engage the inverted T-beam support member to suspend said portion of said ceiling panel therefrom when said ceiling panel is in a predetermined orientation relative to said inverted T-beam support member and said latch structure is in said locking position; and said latch structure being adapted to be moved relative to said ceiling panel and away from said locking position to enable said ceiling panel to be suspended from or separated from the inverted T-beam support member;

wherein said latch structure includes a locking portion extending away from said ceiling panel when said latch structure is in said locking position;

said locking portion being disposed to be engaged by an inverted T-beam support member as said ceiling panel is being moved to said predetermined orientation relative to said inverted T-beam support member;

said latch structure being movable away from said locking position by engagement of said locking portion of said latch structure with said inverted T-beam support member as said ceiling panel is being moved to said predetermined orientation; and said latch structure being biased by gravity to its locking position when said ceiling panel has been moved to said predetermined orientation, to enable said latch structure to support said ceiling panel from said inverted T-beam member when said ceiling panel has been moved to said predetermined orientation.

2. Apparatus as set forth in claim 1 wherein said latch structure comprises a relatively rigid hook-shaped latch member which is coupled with the ceiling panel and adapted to tilt relative to said ceiling panel;

said hook-shaped latch member having a base portion and said locking portion integral therewith;

said base portion being disposed on the inside of said ceiling panel and said locking portion extending outside said ceiling panel;

said base portion being heavier than said locking portion, so that said base portion exerts a gravitational force on said hook-shaped latch member which biases said hook-shaped latch member to said locking position;

the relative rigidity of said hook-shaped latch member causing the hook-shaped latch member to tilt as a rigid body relative to said ceiling panel when said locking portion is engaged by said inverted T-beam support member to tilt said hook-shaped latch member away from its locking position and when said hook-shaped latch member is returned to its locking position under its gravitational bias.

3. Apparatus as set forth in claim 2 wherein said ceiling panel has a main body portion and a side wall extending at an angle to said main body portion;

said side wall having an insertion opening for receiving said hook-shaped latch member as said hook-shaped latch member is being coupled with said ceiling panel;

said hook-shaped latch member being adapted to hook around an edge of said insertion opening in said side wall to couple said hook-shaped latch member to said ceiling panel; and said hook-shaped latch member being adapted to tilt about said edge of said insertion opening in said side wall when said hook-shaped latch member is coupled with said ceiling panel.

4. Apparatus as set forth in claim 3 wherein said base portion of said hook-shaped latch member has retaining means adapted to preclude said base portion from being removed from said insertion opening unless said base portion and said retaining means are disposed in predetermined orientation relative to said insertion opening.

5. Apparatus as set forth in claim 4 wherein said side wall of said ceiling panel includes an access opening spaced from said insertion opening, said base portion of said hook-shaped latch member being disposed proximate to said access opening when said latch is in its locking position, said access opening being located to enable an implement to extend therethrough to exert a force against said base portion of said hook-shaped latch member to tilt said hook-shaped latch member against its gravitational bias and away from its locking position, thereby to enable said ceiling panel to be separated from said inverted T-beam support member.

6. Apparatus as set forth in claim 5, wherein said hook-shaped latch member is integrally formed of aluminum.

7. Apparatus as defined by claim 1 wherein said apparatus comprises a grid comprising a plurality of inverted T-beam support members, a plurality of ceiling panels located below said grid, and latch structure coupled to each of the ceiling panels for enabling each of the ceiling panels to be suspended from or separated from the inverted T-beam support members of the grid.

8. Apparatus as defined in claim 7 wherein said plurality of ceiling panels, when suspended from said grid, combine to form a substantially continuous ceiling.

9. Apparatus as set forth in claim 7 wherein each latch structure comprises a relatively rigid hook-shaped latch member coupled with a respective ceiling panel;

each hook-shaped latch member being adapted to tilt as a relatively rigid body relative to its respective ceiling panel as the ceiling panel is being suspended from or separated from an inverted T-beam support member of said grid.

10. Apparatus comprising a grid comprising a plurality of inverted T-beam support members, a plurality of ceiling panels located below said grid, and latch structure coupled to each of the ceiling panels for enabling each of the ceiling panels to be suspended from or separated from the inverted T-beam support members of the grid;

said plurality of ceiling panels, when suspended from said grid, combining to form a substantially continuous ceiling;

the latch structure coupled with each ceiling panel being biased by gravity toward a locking position relative to its respective ceiling panel; and the latch structure coupled with each ceiling panel being movable against the influence of gravity and relative to its respective ceiling panel to enable its respective ceiling panel to be suspended from or separated from the inverted T-beam support members of the grid without requiring suspension or separation of any adjacent ceiling panels from the inverted T-beam support members of the grid;

wherein each latch structure comprises a relatively rigid hook-shaped latch member coupled with a respective ceiling panel;

each hook-shaped latch member being adapted to tilt as a relatively rigid body relative to its respective ceiling panel as the ceiling panel is being suspended from or separated from an inverted T-beam support member of said grid;

wherein each ceiling panel has a main body portion and a side wall extending away from said main body portion;

said side wall having an insertion opening and an access opening therein;

the hook-shaped latch member associated with the ceiling panel being hooked about the insertion opening of the ceiling panel to couple the hook-shaped latch member with the ceiling panel;

the hook-shaped latch member being adapted to tilt relative to an edge of the insertion opening; and the access opening being located to enable an implement to be inserted therethrough and against the hook-shaped latch member to tilt said hook-shaped latch member against its gravitational bias.

11. Apparatus comprising a ceiling panel having a main body portion and a side wall connected with the main body portion and extending at an angle relative thereto, and a latch structure coupled with the ceiling panel and movable therewith;

said side wall having an insertion opening;

said latch structure comprising a relatively rigid, hook-shaped latch member having a base portion and a locking portion;

said base portion being insertable through said insertion opening, said hook-shaped latch member being hooked around an edge of said insertion opening and being adapted to tilt thereabout relative to said ceiling panel;

said base portion being heavier than said locking portion so that said base portion biases said hook-shaped latch member to a locking position relative to said cutting panel;

said locking portion extending outward from said side wall and at an acute angle thereto when said hook-shaped latch member is in said locking position; and said hook-shaped latch member being tiltable to a position in which said locking portion is disposed substantially adjacent said side wall in order, as said ceiling panel is being suspended from or separated from an inverted T-beam support member.

12. Apparatus as set forth in claim 11 wherein said side wall has an access opening located to enable an implement to extend therethrough to engage the hook-shaped member and to tilt the hook-shaped latch member against its gravitational bias.

13. Apparatus as set forth in claim 12 wherein said hook-shaped member in integrally formed of aluminum.

* * * * *

UNITED STATES PATENT AND TRADEMARK OFFICE

CERTIFICATE OF CORRECTION

PATENT NO. : 5,024,034

DATED : June 18, 1991

INVENTOR(S) : J. Lynn Gailey

It is certified that error appears in the above-identified patent and that said Letters Patent is hereby corrected as shown below:

Column 8, line 63 after "in" insert --a--

Column 10, line 38 after "said" delete "cutting" and insert --ceiling--

Column 10, line 45 after "wall" delete "in order"

Column 10, line 51 after "shaped" (1st occ.) insert--latch--.

Column 10, line 54 after "member" delete "in" and insert --is--

Signed and Sealed this

Twelfth Day of January, 1993

*Attest:*

DOUGLAS B. COMER

*Attesting Officer*

*Acting Commissioner of Patents and Trademarks*